US006822126B2

(12) United States Patent
Miller

(10) Patent No.: US 6,822,126 B2
(45) Date of Patent: Nov. 23, 2004

(54) PROCESS FOR CONVERTING WASTE PLASTIC INTO LUBRICATING OILS

(75) Inventor: Stephen J. Miller, San Francisco, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 44 days.

(21) Appl. No.: 10/126,831

(22) Filed: Apr. 18, 2002

(65) Prior Publication Data

US 2003/0199718 A1 Oct. 23, 2003

(51) Int. Cl.[7] ..... C07C 4/00; C10G 7/00

(52) U.S. Cl. ..... 585/241; 208/18; 208/27; 208/950

(58) Field of Search ..... 208/18, 27, 950; 585/241

(56) References Cited

U.S. PATENT DOCUMENTS

| | | | | |
|---|---|---|---|---|
| 3,845,157 A | | 10/1974 | Woo et al. | |
| 3,852,207 A | | 12/1974 | Stangeland et al. | |
| 3,904,513 A | | 9/1975 | Fischer et al. | |
| 3,997,624 A | * | 12/1976 | Hudgin | 260/683.15 R |
| 4,042,488 A | | 8/1977 | Perciful | |
| 4,053,534 A | | 10/1977 | Mitchell et al. | |
| 4,157,294 A | | 6/1979 | Iwao et al. | |
| 4,482,752 A | | 11/1984 | Mitchell et al. | |
| 4,579,986 A | | 4/1986 | Sie | |
| 4,642,401 A | | 2/1987 | Coenen et al. | |
| 4,673,487 A | | 6/1987 | Miller | |
| 4,921,594 A | | 5/1990 | Miller | |
| 5,105,049 A | | 4/1992 | Hasselbring | |
| 5,118,902 A | | 6/1992 | Drake | |
| 5,135,638 A | | 8/1992 | Miller | |
| 5,246,566 A | | 9/1993 | Miller | |
| 5,282,958 A | | 2/1994 | Santilli et al. | |
| 5,326,919 A | * | 7/1994 | Paisley et al. | 585/241 |
| 5,608,136 A | * | 3/1997 | Maezawa et al. | 588/228 |
| 5,731,483 A | * | 3/1998 | Stabel et al. | 585/241 |
| 5,849,964 A | | 12/1998 | Holighaus et al. | |
| 6,143,940 A | | 11/2000 | Miller et al. | |
| 6,150,577 A | | 11/2000 | Miller et al. | |
| 6,288,296 B1 | * | 9/2001 | Miller et al. | 585/510 |
| 6,497,812 B1 | * | 12/2002 | Schinski | 208/131 |

FOREIGN PATENT DOCUMENTS

EP 0 620 264 A2 10/1994

OTHER PUBLICATIONS

Bridgwater, "A Guide to Fast Pyrolysis of Biomass for Fuels and Chemicals"; *PyNe Guide*, Mar. 1999, 6 pages.

* cited by examiner

*Primary Examiner*—Thuan D. Dang
(74) *Attorney, Agent, or Firm*—Burns, Doane, Swecker & Mathis, L.L.P.

(57) ABSTRACT

Provided is a continuous process for converting waste or virgin plastics into lube oils. The plastic feed is maintained in a heater at preferred temperatures of 150° C.–350° C. The feed is continuously passed to a pyrolysis reactor preferably maintained at a temperature of 450° C.–700° C. and at atmospheric pressure. Relatively short residence times are employed. Optionally, the reactor effluent is processed in a hydrotreating unit. The effluent is fed to an isomerization dewaxing unit and fractionated to recover lube oil stocks. Preferably, the feed to the pyrolysis reactor can be a blend of waste plastic and waxy Fischer-Tropsch fractions.

19 Claims, 2 Drawing Sheets

PROCESS FOR CONVERTING WASTE PLASTIC INTO LUBRICATING OILS

RELATED APPLICATIONS

The present application is related to copending application, Ser. No. 10/126,830, filed concurrently herewith, entitled A PROCESS FOR CONVERTING HEAVY FISCHER-TROPSCH WAXY FEEDS BLENDED WITH A WASTE PLASTIC FEED STREAM INTO HIGH VI LUBE OILS.

BACKGROUND OF THE INVENTION

1. Field of the Invention

The present invention relates to a method for transforming waste polymeric materials into useful products and more particularly to an improved process for manufacturing lubricating oils from waste plastics and Fischer-Tropsch waxes.

2. Description of Related Art

There is a steadily increasing demand for technology capable of converting discarded and waste plastic materials into useful products. This is due in large measure to public concerns over potential environmental damage caused by the presence of these waste materials. According to a recent report from the Office of Solid Waste, about 62% of plastic packaging in the United States is made of polyethylene, the preferred feed for processing waste plastics. Plastics waste is the fastest growing waste product, with about 18 million tons per year in 1995 compared to only four million tons per year in 1970, and this amount is growing by approximately 10% per year. Transforming plastic waste material and particularly polyethylene into useful products presents a unique opportunity to address a growing environmental problem.

Because of environmental concerns, the specifications for fuels, lubricants and other petroleum products have become more stringent. This in turn has lead to a greater demand for lighter and cleaner petroleum feedstocks with the result that supplies of these feedstocks have been dwindling. In response to this, the production of synthetic lubricating oils from Fischer-Tropsch synthesized hydrocarbons has received increased attention, particularly in view of the relatively large amounts of natural gas reserves and the desire to convert these into more valuable products such as paraffinic lubricating oils. Accordingly, it would be advantageous to devise an economical process which converts waste plastic such as polyethylene into high viscosity index (VI) lube oils.

Processes are known which convert waste plastic into hydrocarbon lubricants. For example, U.S. Pat. No. 3,845,157 discloses cracking of waste or virgin polyolefins to form gaseous products such as ethylene/olefin copolymers which are further processed to produce synthetic hydrocarbon lubricants. U.S. Pat. No. 4,642,401 discloses the production of liquid hydrocarbons by heating pulverized polyolefin waste at temperatures of 150–500° C. and pressures of 20–300 bars. U.S. Pat. No. 5,849,964 discloses a process in which waste plastic materials are depolymerized into a volatile phase and a liquid phase. The volatile phase is separated into a gaseous phase and a condensate. The liquid phase, the condensate and the gaseous phase are refined into liquid fuel components using standard refining techniques. U.S. Pat. No. 6,143,940 discloses a procedure for converting waste plastics into heavy wax compositions. U.S. Pat. No. 6,150,577 discloses a process of converting waste plastics into lubricating oils. EP0620264 discloses a process for producing lubricating oils from waste or virgin polyolefins by thermally cracking the waste in a fluidized bed to form a waxy product, optionally using a hydrotreatment, then catalytically isomerizing and fractionating to recover a lubricating oil.

One drawback to any process which converts plastic waste into useful products is the fact that, as with any recycle feed, the quality and consistency of the starting material is an important factor in obtaining quality end products. Recycled waste plastic not only is quite variable in consistency but its quality varies from one extreme to the other due to the many grades and types of plastics on the market. Another key factor is the importance of having a constant and continuous supply to make the process economical particularly when using off-specification waste obtained from polyolefin processing plants (so-called "virgin" polyolefin). A process which economically and efficiently converts plastic waste into high VI lube oils while maintaining control over the quality and quantity of the waste plastic supply and insuring the quality of the end products would be highly desirable.

Therefore, an object of the present invention is to provide an economic and efficient process for converting plastic waste into high VI lube oils.

Another object of the invention is to improve the quality of waste plastic pyrolysis feeds and the quality of the end product.

Still another objective of the invention is to develop an improved process which pyrolyzes plastic waste in combination with Fischer-Tropsch waxy feeds to upgrade the quality of the resultant products.

These and other objects of the present invention will become apparent to the skilled artisan upon a review of the following description, the claims appended thereto and the Figures of the drawings.

SUMMARY OF THE INVENTION

The objects and advantages of the invention are attained by a process which includes the steps of:

passing a waste and/or virgin polyolefin into a heating unit maintained at a temperature below the decomposition point of the polyolefin to provide a molten feed;

continuously passing the molten feed through a flow-through pyrolysis reactor maintained at a temperature sufficient to depolymerize at least a portion of the polyolefin and at an absolute pressure of at least one bar to produce a pyrolyzed effluent;

passing at least a portion of the effluent from the pyrolysis reactor to a catalytic isomerization dewaxing unit;

fractionating the product from the isomerization dewaxing unit; and recovering a lubricating oil base stock.

In a separate embodiment, at least a portion of the pyrolyzed effluent of step (b) is passed to a hydrotreating unit to remove a significant portion of any nitrogen-containing, sulfur-containing and/or oxygenated contaminants. At least a portion of the effluent from the hydrotreating unit is passed to the catalytic isomerization dewaxing unit of step (c).

The process of the invention provides several advantages over previously known techniques. The use of a heating unit enables the practitioner to provide a continuous supply of liquified, heated feedstock readily available for pumping to the pyrolysis reactor. Advantageously, the feedstock is blanketed with inert gas thereby minimizing the formation of oxygenated compounds which could cause downstream catalyst deactivation and could lower the quality of the end products. Continuously passing the polyolefin feed through the pyrolysis reactor allows the practitioner to maintain a low residence time in the reactor which contributes to overall efficiency and economy since a larger volume of feed can be processed. It also enables one to use smaller capacity reactors which likewise provides an economical benefit. Although a hydrotreatment is preferred in the process of the invention to eliminate virtually all nitrogen, sulfur, and oxygen-containing contaminants, such is not necessary if an inert gas has been used to blanket the feed in the heating unit since it has been observed that lube oil stocks lighter in color are obtained by using an inert gas to minimize formation of oxygenated compounds. The use of an intermediate pore size molecule sieve SAPO in the isomerization dewaxing unit minimizes the cracking associated with other known dewaxing techniques.

DETAILED DESCRIPTION OF PREFERRED EMBODIMENTS

Figure 1:
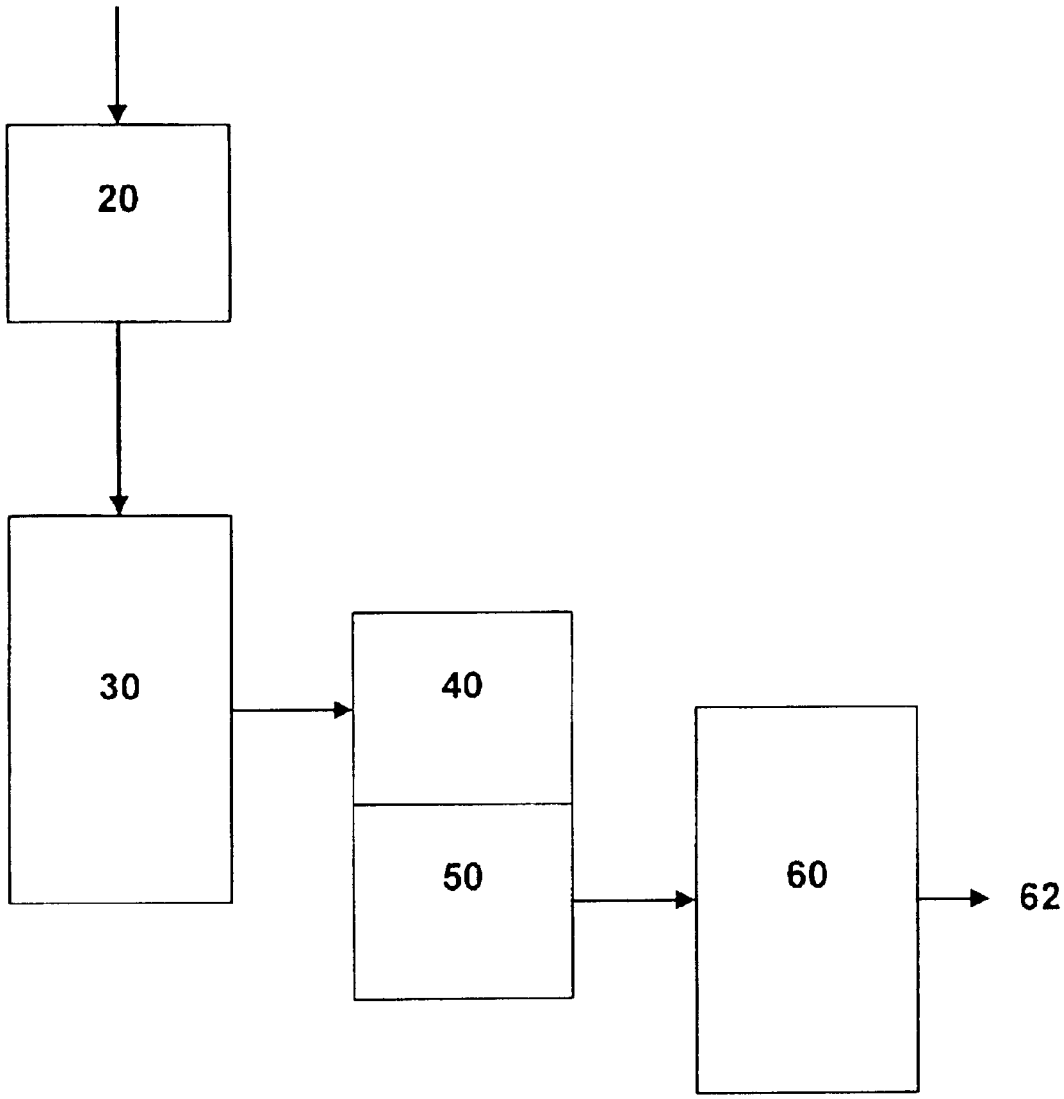
FIG. 1 is a schematic flow diagram of one embodiment of the invention.

With reference to FIG. 1, the first step in the process of the invention involves feeding a plastic material (10) to a heating unit (20). The feed can be a waste plastic, preferably a polyolefin. Suitable plastic waste includes high density and low density polyethylene, polypropylene, EPDM and the like. Typically, the feed is initially prepared by grinding the waste material to a suitable size, removing extraneous material such as metals, etc., and transporting the solids to the heating unit. Alternatively, the solids may be dissolved or dispersed in a suitable solvent and the liquid fed to the heater.

The feed to the heater may also be composed of virgin plastics, e.g., polyolefins which are scrap materials recovered from polyolefin processing during fabrication or other manufacturing techniques. Mixtures of polymer waste and virgin material may be employed, depending upon available supplies. The quality and quantity of the feed can have an impact on the quality of the end products. Recycled waste plastic is quite variable in consistency and its quality varies widely due to the many grades and types of plastics on the market. It is also important to have a constant and continuous supply to make the process economical. With these factors in mind, it is a preferred embodiment of the invention to admix waste and/or virgin plastic with waxy hydrocarbon fractions obtained from a Fischer-Tropsch process. Reference is made to the aforementioned related case, Ser. No. 10/126,830, for a detailed disclosure of procedures for converting waste polymer/Fischer-Tropsch wax blends into high VI lube oils. The entire disclosure of said application is incorporated herein.

One important aspect of the present invention is the use of a heating unit (20) which functions to melt the plastics feed and maintain the liquefied material at a temperature low enough to avoid cracking or any other thermal decomposition. Suitable temperatures range from about 150° C. to about 350° C., preferably about 200° C. to about 350° C., such that the feed is maintained below the temperature at which significant decomposition or depolymerization can occur. Preferably, an inert gas such as nitrogen or argon blankets the heating unit to avoid any significant oxidation of the feed components. Oxidation could give oxygenated impurities which might lead to catalyst poisoning downstream. Avoiding oxidation also would lead to products which are lighter in color. The heating unit also functions as a "holding" vessel which maintains a constant supply of feed for the flow-through pyrolysis reactor.

The molten feed is then continuously forwarded to a pyrolysis unit (30). Typically, a flow-through pyrolysis reactor is employed. The temperature in the reactor normally is maintained between about 450° C. and about 700° C., preferably between about 500° C. and about 650° C., at pressures of less than about 15 bar, preferably in the range of about 1 bar to about 15 bar, and feed rates ranging from about 0.5 to about 5 $hr^{-1}$ LHSV. One important advantage of the invention is the fact that the contact time for the molten feed is relatively short, ranging from as low as about 15 minutes to about an hour or more if necessary. This enables the practitioner to use smaller capacity reactors which lowers production costs. Conducting the pyrolysis at atmospheric conditions allows one to forego the use of equipment to maintain less than atmospheric pressures. Pyrolyzing conditions are variable and can easily be adjusted depending upon the time judged desirable to achieve optimum cracking and depolymerization of the feed materials and the type of product desired (e.g., bright stock, neutral oil, etc.). (The feed may be combined with a lower viscosity liquid, e.g. a diesel or a diesel cut from a fractionator in the process, to lower viscosity and make the feed easier to pump, as well as to help bring in heat to melt the plastic.)

Preferably, the pyrolyzed effluent is pumped to a hydrotreating (HT) unit (40) to remove nitrogen, sulfur and any oxygen-containing compounds which could contaminate the products and poison downstream catalysts. Typical hydrotreating conditions which are employed to remove contaminants while avoiding cracking include temperatures ranging from about 190° C. to about 340° C., pressures ranging from about 400 psig to about 3000 psig, space velocities (LHSV) in the range of about 0.1 $hr^{-1}$ to about 20 $hr^{-1}$, and hydrogen recycle rates ranging from about 400 to about 15,000 SCF/B. Hydrotreating catalysts include those conventionally used in hydrotreating units. Reference is made to the following U.S. patents for a list of suitable catalysts and hydrotreating conditions: U.S. Pat. Nos. 3,852,207; 4,157,294; 4,921,594; 3,904,513; 4,673,487, the disclosures of which are incorporated herein in their entirety.

The pyrolysis effluent, which normally is very waxy, may be pumped directly to an isomerization dewaxing unit (50) (IDW). Since the heavier waxes are difficult to treat in the IDW unit and since the pyrolysis effluent typically contains a broad boiling point range of materials, the effluent may be forwarded to a separation or distillation unit (not shown). The heavy paraffins are thereupon removed and used directly as hydrocarbon waxes. The lighter olefins (i.e., those boiling below about 650° F.) and the gaseous olefins recovered directly from the pyrolysis unit can be forwarded to an oligomerization unit for conversion into lube oil products, normally those boiling in the neutral oil range. Techniques are well known in the art for oligomerizing lower molecular weight alpha-olefins into higher molecular weight hydrocarbons which can be converted into useful fuels, lubricants, etc.

During oligomerization, an olefinic feedstock is contacted with a oligomerization catalyst in a oligomerization zone. Fluid-bed reactors, catalytic distillation reactors, and fixed bed reactors, such as that found in an MTBE or TAME plant, are suitably used as oligomerization reaction zones. Conditions for this reaction in the oligomerization zone are between room temperature and 400° F., preferably between 90 and 275° F., from 0.1 to 3 LHSV, and from 0 to 500 psig, preferably between 50 and 150 psig. Oligomerization catalysts for can be virtually any acidic material including zeolites, clays, resins, $BF_3$ complexes, HF, $H_2SO_4$, $AlCl_3$, ionic liquids (preferably acidic ionic liquids), superacids, etc. The preferred catalyst includes a Group VIII metal on an inorganic oxide support, more preferably a Group VIII metal on a zeolite support. Zeolites are preferred because of their resistance to fouling and ease of regeneration. The most preferred catalyst is nickel on ZSM-5. Catalysts and conditions for the oligomerization of olefins are well known, and disclosed, for example, in U.S. Pat. Nos. 4,053,534; 4,482,752; 5,105,049 and 5,118,902, the disclosures of which are incorporated herein by reference for all purposes.

As indicated above, if a hydrotreating step has been utilized, the product stream therefrom is continuously forwarded to the IDW unit (50). Alternatively, the hydrotreatment effluent may be pumped to a separation unit (not shown) to remove heavy wax materials before sending to the IDW unit. The heavy wax fraction normally boils above 1000° F. and is recovered and used as a high grade heavy wax.

The IDW unit (50) preferably is operated under the conditions described in U.S. Pat. No. 5,135,638, the entire contents of which are incorporated herein. Preferably, the catalyst employed contains a intermediate pore size molecular sieve such as SAPO-11, SAPO-31, SAPO-41 or SM-3. Reference to suitable isomerization dewaxing conditions may also be found in U.S. Pat. No. 5,246,566; and U.S. Pat. No. 5,282,958, the disclosures all of which are incorporated herein in their entirety. Typical reaction conditions in the IDW unit include temperatures ranging from about 200° C. to about 475° C., pressures ranging from about 15 psig to about 3000 psig, a liquid hourly space velocity (LHSV) ranging from about 0.1 $hr^{-1}$ to about 20 $hr^{-1}$, preferably between about 0.2 $hr^{-1}$ to about 10 $hr^{-1}$ and a hydrogen recycle between about 500 to about 30,000 SCF/B, preferably between about 1000 to about 20,000 SCF/B. As is known in the art, isomerization catalytic dewaxing converts n-paraffins into iso-paraffins, thereby reducing the pour point of the resultant oils to form a high VI lube oil at a much higher yield.

At least a portion of the product obtained from the IDW unit is a low pour point lubricating oil stock and can be used as such. Normally, the IDW effluent is forwarded to a distillation unit (60) to separate the effluent into various oil fractions, including a neutral lube oil (62) and a bright stock (63). An amount of diesel (61) is also generally produced. A neutral oil is a refined mineral base oil lubricant with a boiling range above 500° F. and below 1000° F. A bright stock is a lubricating oil hydrocarbon in which about 50 wt % boils over 1000° F.

Figure 2:
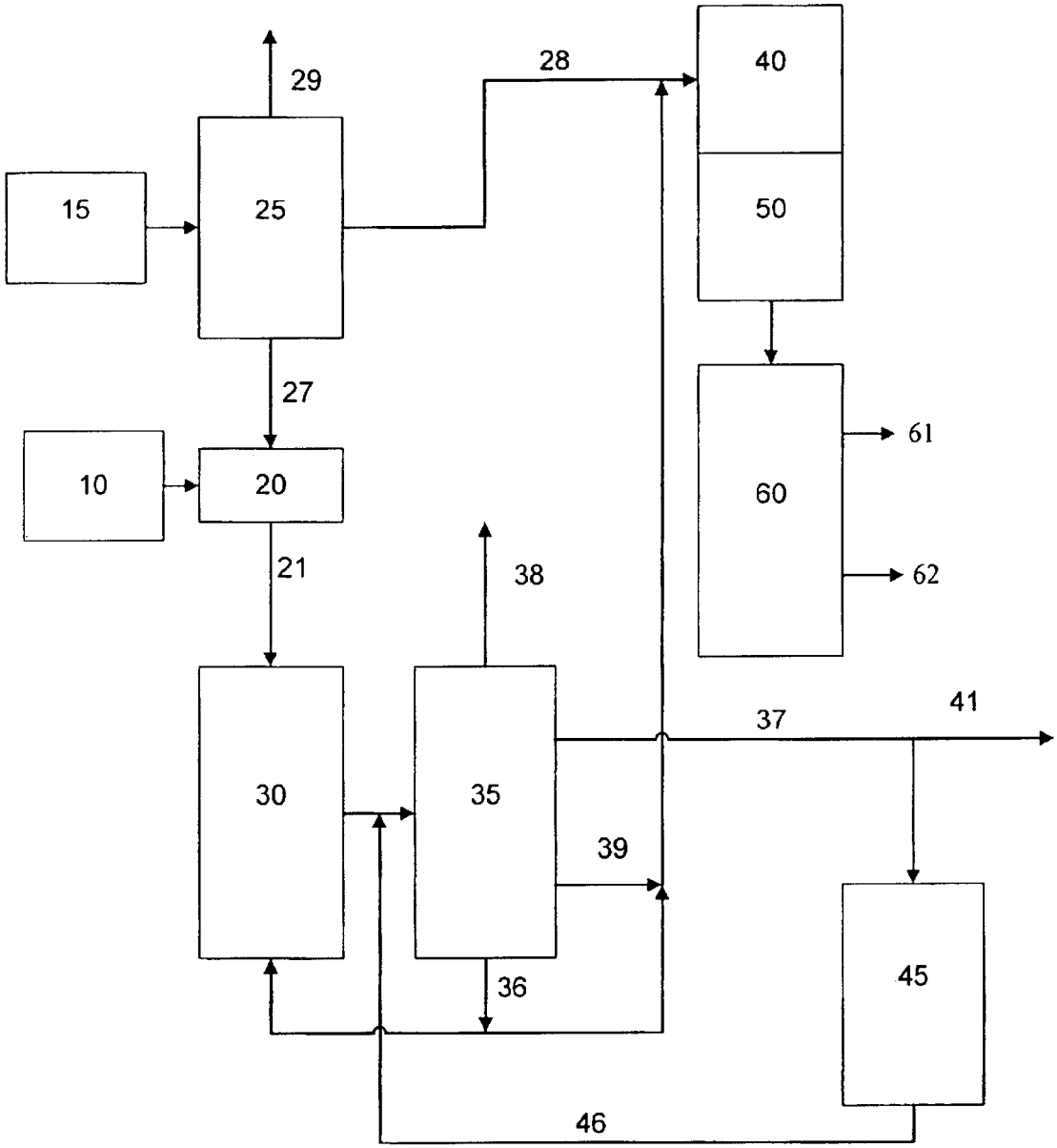
FIG. 2 is a schematic flow diagram of a second embodiment of the invention which pyrolyzes a blend of a waxy Fischer-Tropsch fraction and waste polymer.

A preferred embodiment of the invention as illustrated in FIG. 2 involves blending a heavy wax fraction (27) from a Fischer-Tropsch (Fischer-Tropsch) synthesis with the waste or virgin plastic feed 10. The blending can be done before the feed is sent to the heating unit (20) or the heavy wax fraction can be added to the molten stream being pumped to the pyrolysis unit (30). Typical blends comprise a mixture of 5–95 wt % of a Fischer-Tropsch wax fraction and 95–5 wt % of waste and/or virgin polymer. As shown in FIG. 2, a Fischer-Tropsch waxy feed (15) is forwarded to a separator (25), where a 650° F.-fraction (29) recovered for use as a fuel or a fuel blend, and a 650° F.–1050° F. fraction (28) sent to hydrotreating. The bottoms fraction (27) is circulated to the heater (20) where it is blended with a waste feed (10) The melted stream is continuously pumped to the pyrolysis reactor (30). The pyrolysis effluent is forwarded to fractionator (35). A 390° F.-fraction (38) is recovered for use as a fuel or a fuel blending stock. The lighter 390–650° F. fraction (37) is sent to an oligomerization reactor (45) and the 650° F.–1050° F. middle fraction (39) forwarded to a hydrotreatment unit (40) and then to an IDW unit (50). At least a portion of heavy fraction (36) is sent to hydrotreatment unit (40) and then to IDW unit (50). A portion of heavy fraction may optionally be recycled to the pyrolysis reactor (30). Effluent from unit (50) is processed in fractionator (60) to recover diesel (61), and lube oil (62). Effluent (46) from oligomerization reactor is separated in fractionator (35). A portion of stream (37) may be withdrawn (41) to remove excess unconverted paraffins from the feed to the oligomerization unit. Alternatively, a 390–650° F. fraction may be removed from (46) using a separate fractionator for the oligomerization unit (separation not shown).

The invention will now be illustrated by the following examples which are intended to be merely exemplary and in no manner limiting.

EXAMPLE 1

High density polyethylene (HDPE), obtained from Chevron Chemical Company, was mixed 50/50 by weight with a 550–700° F. hydrocracked diesel. This was put into a 7.5 gallon stainless steel feed pot with a stirrer, and heated under 10 psi nitrogen to 500° F. to melt the plastic and lower the viscosity of the plastic/diesel feed to a point at which it could then be easily pumped. The feed was then pumped upflow, using a gear pump, through a stainless steel reactor containing steel bars to lower the reactor volume to 140 cc. Reactor conditions included a temperature of 975° F., atmospheric pressure, and a residence time of approximately one hour. Products were collected and analyzed.

Table I shows the yields and inspections from the pyrolysis run. The yield of 725° F.+ product, with an endpoint of about 1100° F., suitable for lubricating base oil, was 51.4 wt % based on plastic in the feed. The liquid bottoms collected from that run were then isomerized over a Pt/SAPO-11 catalyst at 500 psig, 600° F., 0.65 LHSV, and 5 MSCF/bbl $H_2$ (followed by a $Pd/SiO_2$-$Al_2O_3$ hydrofinishing catalyst at 450° F. and 1.3 LHSV) to produce a −37° C. pour point 5.4 cSt oil of 156 VI (Table II). The overall 725° F.+ yield, based on plastic to the pyrolyzer was 21.3 wt %.

EXAMPLE 2

Example 1 was repeated, except the plastic was 96 wt % HDPE and 4 wt % waste polyethylene terephthalate. An online stripper separated most of the 600° F. minus product from the higher boiling bottoms product. Pyrolysis yields are given in Table III, showing a 725° F.+ yield, based on plastic, of 42.4 wt %. Table IV gives yields and inspections for isomerization of the pyrolysis bottoms over the same Pt/SAPO-11 catalyst as in Example 1, and the same run conditions except for an isomerization temperature of 675° F. This gave a −13° C. pour point 4.9 cSt oil of 160 VI. The overall 725° F.+ yield, based on plastic to the pyrolyzer, was 25.3 wt %. Since the pyrolysis overhead gas and liquid were highly olefinic, oligomerization of these olefins could produce additional low pour point lube base oil.

EXAMPLE 3

A portion of the pyrolysis bottoms made in Example 2 was hydrotreated over a Ni—W/SiO2-Al2O3 catalyst at 600° F., 1.5 LHSV, 1950 psig, and 5 MSCF/bbl H2 to reduce heteroatom content in the feed. At these conditions, cracking of the feed was very low. The hydrotreated feed was then isomerized over the same Pt/SAPO-11 catalyst as in Example I, and the same conditions, except for an isomerization temperature of 670° F. and pressure of 1950 psig. This gave a −34° C. pour point 3.0 cSt oil of 131 VI (Table V). The overall 725° F.+ yield, based on plastic to the pyrolyzer, was 17.2 wt %. It is believed the yield and VI would have been higher had the oil been run to a higher pour point, and distilled to the same viscosity as in Example 2.

EXAMPLE 4

The pyrolysis run of Example 1 was repeated (Table VI) at the same conditions, but this time on a feed composed of a 50/50 mixture by weight of low density polyethylene (LDPE), obtained from Chevron Chemical Company, and a hydrotreated Fischer-Tropsch wax, obtained from Moore & Munger (Table VII). Yields are given in Table VI, showing a 725° F.+ yield of 57.5 wt %. The yield for a broader lube feed, 650° F.+, was 66.0 wt %. While there was considerable 1000° F.+ in the feed to the pyrolyzer, there was little 1000° F.+ in the product, which is believed here to be advantageous for low cloud point. The pyrolysis bottoms were then isomerized over the same Pt/SAPO-11 catalyst as in Example 1, and at the same conditions, except for an isomerization temperature of 687° F., to give a −22° C. pour point 4.4 cSt oil of 154 VI (Table VIII). The overall 725° F.+ yield, based on feed to the pyrolyzer, was 34.8 wt %. For overall 650° F.+, the yield was 43.7 wt %. Adding the potential lube from oligomerizing the lighter olefinic product from the pyrolyzer would increase these yields still further.

Table VII lists properties of four feed (A=Diesel Diluent: B=Moore & Munger FT Wax: C=hydrotreated heavy (i.e. bottoms) fraction from pyrolyzed HDPE/PET/Diesel: D=hydrotreated heavy (i.e. bottoms) fraction from pyrolyzed LDPE/FT Wax).

EXAMPLE 5

A portion of the pyrolysis bottoms from Example 4 was hydrotreated over the Ni—W/SiO2-Al2O3 catalyst as in Example 3. This was then isomerized as in Example 4, except for a isomerization temperature of 640° F. This gave a −15° C. pour point 3.8 cSt oil with a 150 VI (Table IX). The overall 725° F.+ yield, based on feed to the pyrolyzer, was 31.2 wt %. For overall 650° F.+, the yield was 39.7 wt %.

EXAMPLE 6

HDPE beads were admixed with diesel oil to form a 50/50 by weight feed. The feed was pumped to a heating unit maintained at a temperature of 500° F. The feed was blanketed with nitrogen to minimize oxidation. The heated feed was then continuously pumped upward through a pyrolysis reactor equipped with preheat bars to maintain a reaction temperature of 1025° F. and atmospheric pressure. Residence time for the feed was 1 hour. The pyrolyzed product was stripped at a temperature of about 550° F. with the overhead and bottoms liquids collected separately. The bottoms, which were quite light in color, were forwarded to an IDW unit. Isomerization dewaxing was performed under the following conditions: 675° F., 0.5 LHSV, 1950 psig, and 3.6 MSCF/BBL of once-through H2. The product from the IDW unit was fractionated. Analysis of the yield and composition thereof is set forth in Table X.

TABLE I

Pyrolysis of 50/50 by Weight Plastic/Diesel at 975° F., Atmospheric Pressure, and 1 Hr Residence Time
Plastic = HDPE

| | |
|---|---|
| Yield, Wt % | |
| C1 | 0.5 |
| C2= | 0.8 |
| C2 | 0.6 |
| C3= | 1.2 |
| C3 | 0.5 |
| C4= | 0.8 |
| C4 | 0.5 |
| C4− | 4.9 |
| C5-350° F. | 9.6 |
| 350–650° F. | 56.0 |
| 650–725° F. | 3.8 |
| 725° F.+ | 25.7 |
| 725° F.+, based on plastic | 51.4 |
| Bottoms | |
| Wt % of feed | 92.0 |
| Gravity, API | 42.7 |
| Sulfur, ppm | <1.5 |
| Nitrogen, ppm | 1.3 |
| Sim. Dist., ° F., Wt % | |
| ST/5 | 149/302 |
| 10/30 | 390/506 |
| 50 | 572 |
| 70/90 | 692/955 |
| 95/EP | 1011/1109 |

TABLE II

Isomerization Dewaxing of Pyrolyzed Product from HDPE/Diesel at 500 psig, 600° F., 0.65 LHSV, and 5 MSCF/bbl $H_2$

| | |
|---|---|
| Yield, Wt % | |
| C3 | 0.8 |
| C4 | 2.9 |
| C4− | 3.7 |
| C5-350° F. | 25.3 |
| 350–650° F. | 56.1 |
| 650–725° F. | 3.3 |
| 725° F.+ | 11.6 |
| 725° F.+, based on 725° F.+ to IDW | 41.1 |
| Overhead | |
| Wt % of Feed | 75.9 |
| Sim. Dist., ° F., Wt % | |
| ST/5 | 73/194 |
| 10/30 | 243/367 |
| 50 | 448 |
| 70/90 | 520/584 |
| 95/EP | 605/647 |
| Bottoms | |
| Wt % of feed | 15.4 |
| Pour Point, ° C. | −37 |
| Cloud Point, ° C. | +9 |
| Viscosity, 40° C., cSt | 25.43 |
| 100° C., cSt | 5.416 |
| VI | 156 |
| Sim. Dist., ° F., Wt % | |
| ST/5 | 621/655 |
| 10/30 | 674/745 |
| 50 | 844 |
| 70/90 | 925/1051 |
| 95/EP | 1094/1153 |
| Overall Wt % 725° F.+, based on plastic | 21.3 |

TABLE III

| Pyrolysis of 50/50 by Weight Plastic/Diesel at 975° F., Atmospheric Pressure, and 1 Hr Residence Time Plastic = 96 wt % HDPE/4 wt % PET | |
|---|---|
| Yield, Wt % | |
| C1 | 0.2 |
| C2= | 0.5 |
| C2 | 0.4 |
| C3= | 0.6 |
| C3 | 0.4 |
| C4= | 0.6 |
| C4 | 0.2 |
| C4– | 2.9 |
| C5-350° F. | 15.6 |
| 350–650° F. | 52.7 |
| 650–725° F. | 7.6 |
| 725° F.+ | 21.2 |
| 725° F.+, based on plastic | 42.4 |
| Overhead | |
| Wt % of Feed | 56.2 |
| P + N/Olefins/Aromatics | 41.0/56.0/3.0 |
| Sim. Dist., ° F., Wt % | |
| ST/5 | 106/194 |
| 10/30 | 231/382 |
| 50 | 513 |
| 70/90 | 568/621 |
| 95/EP | 649/784 |
| Bottoms | |
| Wt % of feed | 39.5 |
| Gravity, API | 40.0 |
| Sulfur, ppm | 3.6 |
| Nitrogen, ppm | 6.1 |
| Sim. Dist., ° F., Wt % | |
| ST/5 | 458/525 |
| 10/30 | 555/629 |
| 50 | 732 |
| 70/90 | 821/911 |
| 95/EP | 944/995 |

TABLE IV

| Isomerization Dewaxing of Pyrolyzed Product from HDPE/PET/Diesel at 500 psig, 675° F., 0.65 LHSV, and 5 MSCF/bbl $H_2$ (Hydrofinish at 450° F. and 1.3 LHSV) | |
|---|---|
| Yield, Wt % | |
| C3 | 0.5 |
| C4 | 1.4 |
| C4– | 1.9 |
| C5-350° F. | 7.4 |
| 350–650° F. | 46.3 |
| 650–725° F. | 13.4 |
| 725° F.+ | 31.0 |
| 725° F.+, based on 725° F.+ to IDW | 68.9 |
| Overhead | |
| Wt % of Feed | 56.9 |
| Sim. Dist., ° F., Wt % | |
| ST/5 | 156/288 |
| 10/30 | 368/538 |
| 50 | 582 |
| 70/90 | 613/650 |
| 95/EP | 665/694 |
| Bottoms | |
| Wt % of feed | 38.7 |
| Pour Point, ° C. | −13 |
| Cloud Point, ° C. | +6 |
| Viscosity, 40° C., cSt | 21.63 |

TABLE IV-continued

| Isomerization Dewaxing of Pyrolyzed Product from HDPE/PET/Diesel at 500 psig, 675° F., 0.65 LHSV, and 5 MSCF/bbl $H_2$ (Hydrofinish at 450° F. and 1.3 LHSV) | |
|---|---|
| 100° C., cSt | 4.920 |
| VI | 160 |
| Sim. Dist., ° F., Wt % | |
| ST/5 | 655/684 |
| 10/30 | 699/752 |
| 50 | 810 |
| 70/90 | 873/958 |
| 95/EP | 999/1085 |
| Overall Wt % 725° F.+, based on plastic | 25.3 |

TABLE V

| Isomerization Dewaxing of Hydrotreated Pyrolyzed Product from HDPE/PET at 1950 psig, 670° F., 0.65 LHSV, and 5 MSCF/bbl $H_2$ (Hydrofinish at 450° F. and 1.3 LHSV) | |
|---|---|
| Yield, Wt % | |
| C1 | 0.1 |
| C2 | 0.2 |
| C3 | 2.7 |
| C4 | 6.2 |
| C4– | 9.2 |
| C5-350° F. | 22.3 |
| 350–650° F. | 41.7 |
| 650–725° F. | 6.0 |
| 725° F.+ | 20.8 |
| 725° F.+, based on 725° F.+ to IDW | 37.1 |
| Overhead | |
| Wt % of Feed | 40.3 |
| Sim. Dist., ° F., Wt % | |
| ST/5 | 72/152 |
| 10/30 | 193/297 |
| 50 | 395 |
| 70/90 | 505/553 |
| 95/EP | 569/598 |
| Bottoms | |
| Wt % of feed | 45.0 |
| Pour Point, ° C. | −34 |
| Cloud Point, ° C. | −3 |
| Viscosity, 40° C., cSt | 10.86 |
| 100° C., cSt | 2.967 |
| VI | 131 |
| Sim. Dist., ° F., Wt % | |
| ST/5 | 510/565 |
| 10/30 | 587/642 |
| 50 | 710 |
| 70/90 | 793/899 |
| 95/EP | 941/1041 |
| Overall Wt % 725° F.+, based on plastic | 17.2 |

TABLE VI

| Pyrolysis of 50/50 by Weight LDPE/FT Wax at 975° F., Atmospheric Pressure, and 1 Hr Residence Time | |
|---|---|
| Yield, Wt % | |
| C1 | 0.2 |
| C2= | 0.6 |
| C2 | 0.4 |
| C3= | 0.9 |
| C3 | 0.7 |
| C4= | 0.9 |
| C4 | 0.4 |

TABLE VI-continued

| Pyrolysis of 50/50 by Weight LDPE/FT Wax at 975° F., Atmospheric Pressure, and 1 Hr Residence Time | |
|---|---|
| C4– | 4.1 |
| C5-350° F. | 9.9 |
| 350–650° F. | 20.0 |
| 650–725° F. | 8.5 |
| 725° F.+ | 57.5 |
| Overhead | |
| Wt % of Feed | 17.1 |
| P + N/Olefins/Aromatics | 22.0/76.0/2.0 |
| Sim. Dist., ° F., Wt % | |
| ST/5 | 114/201 |
| 10/30 | 215/307 |
| 50 | 378 |
| 70/90 | 455/550 |
| 95/EP | 599/692 |
| Bottoms | |
| Wt % of feed | 76.0 |
| Gravity, API | 40.7 |
| Sulfur, ppm | <4 |
| Nitrogen, ppm | 7.9 |
| Sim. Dist., ° F., Wt % | |
| ST/5 | 460/580 |
| 10/30 | 633/757 |
| 50 | 850 |
| 70/90 | 910/979 |
| 95/EP | 1002/1051 |

TABLE VII

| | Feed Inspections | | | |
|---|---|---|---|---|
| Feed | A | B | C | D |
| Gravity, ° API | | 38.2 | 40.5 | 42.1 |
| Nitrogen, ppm | | 1.9 | | |
| Sim. Dist., ° F., Wt % | | | | |
| ST/5 | 505/533 | 791/856 | 255/518 | 118/544 |
| 10/30 | 553/621 | 876/942 | 553/648 | 598/744 |
| 50 | 670 | 995 | 753 | 842 |
| 70/90 | 699/719 | 1031/1085 | 840/928 | 914/985 |
| 95/EP | 725/735 | 1107/1133 | 964/1023 | 1011/1068 |

TABLE VIII

| Isomerization Dewaxing of Pyrolyzed Product from 50/50 LDPE/FT Wax at 500 psig, 687° F., 0.65 LHSV, and 5 MSCF/bbl $H_2$ (Hydrofinish at 450° F. and 1.3 LHSV) | |
|---|---|
| Yield, Wt % | |
| C3 | 0.5 |
| C4 | 0.9 |
| C4– | 1.4 |
| C5-350° F. | 8.7 |
| 350–650° F. | 32.6 |
| 650–725° F. | 11.5 |
| 725° F.+ | 45.8 |
| Overhead | |
| Wt % of Feed | 34.9 |
| Sim. Dist., ° F., Wt % | |
| ST/5 | 157/246 |
| 10/30 | 292/430 |
| 50 | 512 |
| 70/90 | 569/611 |
| 95/EP | 621/641 |

TABLE VIII-continued

| Isomerization Dewaxing of Pyrolyzed Product from 50/50 LDPE/FT Wax at 500 psig, 687° F., 0.65 LHSV, and 5 MSCF/bbl $H_2$ (Hydrofinish at 450° F. and 1.3 LHSV) | |
|---|---|
| Bottoms | |
| Wt % of feed | 60.9 |
| Pour Point, ° C. | −22 |
| Cloud Point, ° C. | −2 |
| Viscosity, 40° C., cSt | 18.70 |
| 100° C., cSt | 4.416 |
| VI | 154 |
| Sim. Dist., ° F., Wt % | |
| ST/5 | 614/646 |
| 10/30 | 668/745 |
| 50 | 819 |
| 70/90 | 885/961 |
| 95/EP | 991/1088 |
| Overall Wt % 725° F.+, based on feed | 34.8 |
| Overall Wt % 650° F.+, based on feed | 43.7 |

TABLE IX

| Isomerization Dewaxing of Hydrotreated Pyrolyzed Product from 50/50 LDPE/FT at 500 psig, 640° F., 0.65 LHSV, and 5 MSCF/bbl $H_2$ (Hydrofinish at 450° F. and 1.3 LHSV) | |
|---|---|
| Yield, Wt % | |
| C2 | 0.1 |
| C3 | 0.8 |
| C4 | 1.7 |
| C4– | 2.6 |
| C5-350° F. | 13.7 |
| 350–650° F. | 31.7 |
| 650–725° F. | 11.0 |
| 725° F.+ | 41.0 |
| Overhead | |
| Wt % of Feed | 31.9 |
| Sim. Dist., ° F., Wt % | |
| ST/5 | 81/190 |
| 10/30 | 238/344 |
| 50 | 438 |
| 70/90 | 508/565 |
| 95/EP | 586/682 |
| Bottoms | |
| Wt % of feed | 61.6 |
| Pour Point, ° C. | −15 |
| Cloud Point, ° C. | −2 |
| Viscosity, 40° C., cSt | 15.23 |
| 100° C., cSt | 3.829 |
| VI | 150 |
| Sim. Dist., ° F., Wt % | |
| ST/5 | 564/601 |
| 10/30 | 623/710 |
| 50 | 798 |
| 70/90 | 878/962 |
| 95/EP | 995/1067 |
| Overall Wt % 725° F.+, based on feed | 31.2 |
| Overall Wt % 650° F.+, based on feed | 39.7 |

TABLE X

| Isomerization Dewaxing of Pyrolyzed Product from HDPE/Diesel at 675° F., 1950 psig, 0.5 LHSV, and 3.6 MSCF/bbl $H_2$ (Hydrofinish at 450° F. and 1.3 LHSV) | |
|---|---|
| C4– | 0.5 |
| C5, −180° F. | 2.3 |

TABLE X-continued

| Isomerization Dewaxing of Pyrolyzed Product from HDPE/Diesel at 675° F., 1950 psig, 0.5 LHSV, and 3.6 MSCF/bbl $H_2$ (Hydrofinish at 450° F. and 1.3 LHSV) | |
|---|---|
| 180–300° F. | 3.7 |
| 300–725° F. | 73.5 |
| 725° F.+ | 20.00 |
| 725° F.+ Conversion | 27.5 |
| | wt. % |
| 725° F.+ Overhead | |
| Wt % of IDW Feed | 74.3 |
| St/5 | 175/287 |
| 10/30 | 361/531 |
| 50 | 601 |
| 70/90 | 661/707 |
| 95/EP | 720/759 |
| 725° F.+ Bottoms | |
| Wt % of IDW Feed | 19.4 |
| Wt % of Plastic Feed to Process | 26.7 |
| St/5 | 686/722 |
| 10/30 | 744/818 |
| 50 | 882 |
| 70/90 | 948/1028 |
| 95/EP | 1056/1110 |
| Pour Pt, ° C. | −9 |
| Cloud Pt. ° C. | +14 |
| Viscosity, 40° C., cSt | 34.35 |
| 100° C., cSt | 6.891 |
| VI | 165 |

It is clear from the above that the invention provides an efficient process wherein a waste or virgin polyolefin is heated and continuously processed through a pyrolyzing reactor at low residence times and at atmospheric pressure followed by isomerization dewaxing to produce high yields of lube oil stocks. Shorter residence times mean that smaller reactors can be used. The light olefins from the pyrolysis can be oligomerized to form useful higher molecular weight products. Process conditions in the reactor can be altered to vary the types of products obtained, i.e., neutral oil and/or bright stock. Waxy Fischer-Tropsch products can be blended with the waste polymer feed to the pyrolysis reactor to maintain quality of the feed and quality of the end products. Catalysts and conditions for performing Fischer-Tropsch reactions are well known to those of skill in the art, and are described, for example, in EP 0 921 184A1, the contents of which are hereby incorporated by reference in their entirety.

While the invention has been described with preferred embodiments, it is to be understood that variations and modifications may be understood that variations and modifications may be resorted to as will be apparent to those skilled in the art. Such variations and modifications are to be considered within the purview and the scope of the claims appended hereto.

What is claimed is:

1. A continuous process for converting waste plastic into lube oil stock comprising:

(a) passing a waste and/or virgin polyolefin into a heating unit blanketed with an inert gas and maintained at a temperature between 150° C. and 350° C. to provide a molten feed;

(b) continuously passing the molten feed through a flow-through pyrolysis reactor maintained at a temperature sufficient to depolymerize at least a portion of the polyolefin and at an absolute pressure of at least one bar to produce a pyrolyzed effluent;

(c) passing at least a portion of the effluent from the pyrolysis reactor to a catalytic isomerization dewaxing unit;

(d) fractionating the product from the isomerization dewaxing unit; and (e) recovering a lubricating oil base stock.

2. A process according to claim 1, wherein the lubricating oil base stock comprises a neutral oil and/or a bright stock.

3. A process according to claim 1, wherein the polyolefin is a polyethylene, a polypropylene or an EPDM elastomer.

4. A process according to claim 3, wherein the polyolefin is a high density or low density polyethylene.

5. A process according to claim 1, further comprising passing at least a portion of the pyrolyzed effluent of step (b) to a hydrotreating unit to remove a significant portion of any nitrogen-containing, sulfur-containing and/or oxygenated contaminants; and passing at least a portion of the effluent from the hydrotreating unit to the catalytic isomerization dewaxing unit of step (c).

6. A process according to claim 1, wherein the catalyst in the isomerization dewaxing unit contains an intermediate pore size molecular sieve SAPO.

7. A process according to claim 1, wherein the molten feed comprises 5–95 wt % of the polyolefin.

8. A process according to claim 7, wherein the molten feed comprises 95–5 wt % of a Fischer-Tropsch wax.

9. A process according to claim 1, wherein the feed rate in the pyrolysis reactor ranges from about 0.5 to about 5.0 $hr^{-1}$ LHSV.

10. A process according to claim 1, wherein the temperature in the pyrolysis reactor is in the range of about 450° C. to about 700° C.

11. A continuous process for converting waste or virgin plastic into lube oil stock comprising the steps of:

(a) passing solid waste and/or virgin polyethylene or a liquid containing said polyethylene into a heating unit maintained at a temperature of about 200° C. to about 350° C. and under a blanket of an inert gas to provide a heated feed;

(b) continuously passing the heated feed through a pyrolysis flow-through reactor maintained at a temperature of about 500° C. to about 650° C., a pressure of about 1 bar, and a residence time up to about 1 hour to produce a pyrolyzed effluent;

(c) passing the effluent from the pyrolysis reactor to a separator and recovering at least a heavy fraction;

(d) passing at least a portion of the said heavy fraction to a catalytic isomerization dewaxing unit;

(e) passing the product from the isomerization dewaxing unit to a distillation unit; and, recovering a lube oil stock.

12. A process of claim 11, wherein the polyethylene contains a high molecular weight fraction which is removed prior to forwarding to the heating unit.

13. A process of claim 11, wherein the catalyst in the isomerization dewaxing unit comprises a molecular sieve SAPO.

14. A process of claim 11, wherein said heated polyethylene feed contains a heavy Fischer-Tropsch wax.

15. A process of claim 11 further comprising passing at least a portion of the heavy fraction of step (c) to a hydrotreating unit and passing the product from the hydrotreating unit to the catalytic isomerization dewaxing unit of step (d).

16. A process according to claim 1, wherein the effluent of the pyrolysis reactor is separated into at least a light fraction, a middle fraction and a heavy fraction.

17. A process according to claim 16, wherein at least a portion of the heavy fraction is circulated back to the pyrolysis reactor.

18. A process according to claim 16, wherein at least a portion of the light fraction is circulated to a oligomerization reactor.

19. A process according to claim 16, wherein at least a portion of the middle fraction is circulated to a hydrotreating unit and a catalytic isomerization dewaxing unit.

* * * * *

UNITED STATES PATENT AND TRADEMARK OFFICE

CERTIFICATE OF CORRECTION

PATENT NO. : 6,822,126 B2
DATED : November 23, 2004
INVENTOR(S) : Stephen J. Miller It is certified that error appears in the above-identified patent and that said Letters Patent is hereby corrected as shown below:

Column 14,
Line 4, please delete “dew-” and insert -- de- -- in place thereof.
Line 5, please delete “axing” and insert -- waxing -- in place thereof.

Column 15,
Line 3, please delete “claim 1,” and insert -- claim 11, -- in place thereof.

Signed and Sealed this

Sixteenth Day of August, 2005

JON W. DUDAS
*Director of the United States Patent and Trademark Office*